US008893621B1

(12) United States Patent
Escobar

(10) Patent No.: US 8,893,621 B1
(45) Date of Patent: Nov. 25, 2014

(54) PROJECTILE

(71) Applicant: Rolando Escobar, Surfside, FL (US)

(72) Inventor: Rolando Escobar, Surfside, FL (US)

( * ) Notice: Subject to any disclaimer, the term of this patent is extended or adjusted under 35 U.S.C. 154(b) by 20 days.

(21) Appl. No.: 14/099,944

(22) Filed: Dec. 7, 2013

(51) Int. Cl.
*F42B 10/44* (2006.01)

(52) U.S. Cl.
USPC ..... 102/503; 102/501; 102/524

(58) Field of Classification Search
USPC ..... 102/439, 490, 501, 506, 507, 508, 509, 102/514, 524
See application file for complete search history.

(56) References Cited

U.S. PATENT DOCUMENTS

| | | | | | |
|---|---|---|---|---|---|
| 753,504 | A | * | 3/1904 | Meigs | 102/501 |
| 1,043,547 | A | * | 11/1912 | Stanbridge | 102/501 |
| 2,493,938 | A | * | 1/1950 | Albree | 102/439 |
| 2,682,224 | A | * | 6/1954 | Braverman | 102/507 |
| 3,003,420 | A | * | 10/1961 | Nosler | 102/508 |
| 3,873,048 | A | * | 3/1975 | Platou | 244/3.1 |
| 3,939,773 | A | * | 2/1976 | Jenkins et al. | 102/526 |
| 4,063,511 | A | * | 12/1977 | Bullard | 102/436 |
| 4,109,581 | A | * | 8/1978 | Six | 102/501 |
| 4,296,893 | A | * | 10/1981 | Ballmann | 244/3.23 |
| 4,782,758 | A | * | 11/1988 | Washburn | 102/434 |
| 4,807,535 | A | * | 2/1989 | Schilling et al. | 102/490 |
| 4,836,108 | A | * | 6/1989 | Kegel et al. | 102/306 |
| 4,854,242 | A | * | 8/1989 | Katzmann | 102/522 |
| 4,970,960 | A | * | 11/1990 | Feldmann | 102/506 |
| 5,058,503 | A | * | 10/1991 | Adams, III | 102/501 |
| 5,105,744 | A | | 4/1992 | Petrovich | |
| 5,259,319 | A | * | 11/1993 | Dravecky et al. | 102/447 |
| 5,385,101 | A | * | 1/1995 | Corzine et al. | 102/509 |
| 5,404,815 | A | | 4/1995 | Reed | |
| 5,476,045 | A | * | 12/1995 | Chung et al. | 102/529 |
| 5,767,438 | A | * | 6/1998 | Lang et al. | 102/444 |
| 6,186,071 | B1 | | 2/2001 | Fry | |
| 6,244,186 | B1 | | 6/2001 | Pichard | |
| 6,244,187 | B1 | | 6/2001 | Head | |
| 6,629,669 | B2 | * | 10/2003 | Jensen | 244/3.23 |
| 6,964,232 | B2 | * | 11/2005 | Eberhart et al. | 102/439 |
| 7,210,260 | B1 | | 5/2007 | Smalley | |
| 7,299,750 | B2 | * | 11/2007 | Schikora et al. | 102/506 |
| 7,302,891 | B1 | * | 12/2007 | Adams | 102/514 |
| 7,380,505 | B1 | | 6/2008 | Shiery | |
| 7,503,260 | B2 | | 3/2009 | Kapeles | |
| 7,520,224 | B2 | | 4/2009 | Taylor | |
| 8,186,277 | B1 | | 5/2012 | King | |
| 8,316,769 | B2 | | 11/2012 | Wilson | |
| 8,413,587 | B2 | | 4/2013 | Emary | |
| 2006/0124022 | A1 | * | 6/2006 | Eberhart et al. | 102/508 |
| 2008/0134928 | A1 | | 6/2008 | Shiery | |
| 2011/0155016 | A1 | * | 6/2011 | Marx | 102/524 |
| 2011/0252997 | A1 | * | 10/2011 | Hoffman | 102/439 |

* cited by examiner

*Primary Examiner* — Bret Hayes
*Assistant Examiner* — Derrick Morgan
(74) *Attorney, Agent, or Firm* — Christopher J. Vandam, PA; Chris Vandam

(57) ABSTRACT

A projectile comprised of an ogive section, a bearing surface section and a boattail section. A cavity is formed inside the projectile from an aperture on the aft end of the boattail section and forward to about the transition point (shoulder) between the ogive section and bearing surface section. The cavity is centered about the centerline of the projectile and open on the aft end of the projectile.

6 Claims, 2 Drawing Sheets

PROJECTILE

BACKGROUND OF THE INVENTION

1. Field of the Invention

The present invention relates to projectiles, and more particularly, to projectiles for air guns, firearms and other small arms.

2. Description of the Related Art

Several designs for projectiles have been designed in the past. None of them, however, includes a cavity in the center of the projectile coupled with the specific proportions of the various aspects of the presently disclosed device.

Applicant believes that the closest reference corresponds to U.S. Pat. No. 8,186,277 issued to King on 29 May 2012. However, it differs from the present invention, because among other reasons, the King device has a cavity on the forward edge of his projectile that is deformable upon impact with no analogous cavity in the rear side of the projectile as shown and described in the present invention.

The present invention, in at least one important version, includes no cavity at the tip of the projectile and instead has a cavity from the rear of the projectile towards a predetermined point forward of the rear side. Where the King features are directed towards impact and avoiding the use of lead, the present device is more directed towards accuracy and stability during flight.

Applicant also believes that U.S. Pat. No. 8,316,769 issued to Wilson on 27 Nov. 2012 shows a projectile that includes a generally hollow cavity in the base of a non-lethal projectile. However, this projectile lacks the superior ballistic performance and stability of the presently disclosed and claimed invention.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a projectile that has superior flight stability characteristics.

It is another object of this invention to provide a projectile that is stable and is highly effective at both supersonic and subsonic velocities in a variety of weapons.

It is still another object of the present invention to provide a projectile that is highly accurate and controllable in a variety of firearms, air guns and other weapons and that addresses problems of stability found in many prior art projectiles that have been known and used by military, sport competition, and hunters over the past one hundred and fifty years around the world.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Projectiles, also sometimes referred to as bullets in small arms, is generally any object that is forced from the barrel of a gun under pressure. These projectiles can range from a pellet (or BB) gun powered by compressed air, a spring, or other similar means to battlefield artillery that may have a bore diameter of thirty centimeters or more.

Since about the middle of the $19^{th}$ century, rifling in gun barrels has become commonplace. Rifling is a precise feature of the interior of a gun barrel that imparts a rotation upon the projectile as it travels through the barrel. The rotation of the projection aids in a true flight path of the projectile and therefore increasing the ability of the shooter to hit a selected target.

Figure 1:
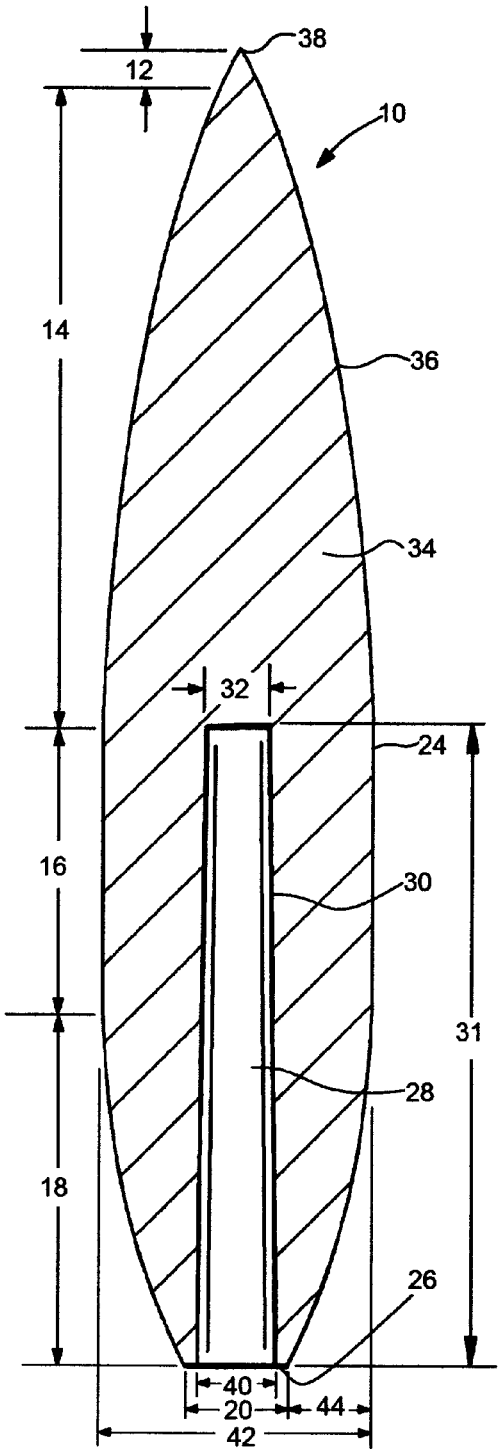
FIG. 1 represents plan view cross section of an example of a projectile.

Referring now to the drawings, where an important version of the present invention is generally referred to with numeral 10 in FIG. 1. It can be observed in the drawings that this version of the invention basically includes a nose 12, an ogive 14, a bearing surface 16, a boattail 18 (sometimes referred to as the tail), a base 20, a shoulder 24, a heel 26, a cavity 28, an edge 30, a bottom 32, a body 34, a surface 36, a tip 38, an aperture 40, a caliber 42 and a draft 44.

It should be noted that in the specification and in the claims the term and element ogive 14 is sometimes referred to as ogive section, bearing surface 16 is sometimes referred to as bearing surface section and boattail 18 is sometimes referred to as boattail section. These are intended to be analogous terms.

In flight, the tip 38 leads in the flight path and the heel 26 is at the aft end of the projectile. For purposes of this discussion a sample projectile has four zones. The forward most is the nose 12 that would make contact with the target.

The next section towards the aft is the ogive 14 identified in FIG. 1 by the sloping curve. The ogive 14 could equally have square or other profiles and still fall within the scope of the inventive concepts. The ogive 14 region of the projectile contains a significant proportion of mass of the projectile.

The shoulder 24 is the point where the ogive 14 transitions into the bearing surface 16. Continuing aft from the shoulder 24 is the bearing surface 16 region of the projectile. When fired, the bearing surface 16 is in contact with the interior surface of the barrel through which the projectile is fired. To be more precise, in many barrels the bearing surface will contact the lands that comprise the barrel's rifling.

It should be noted that the bearing surface 16 region in most applications is nearly perfectly cylindrical. In other words, the left exterior edge of the bearing section 16 as shown in FIG. 1 is parallel to the right exterior edge. The bearing surface aids in keeping the center line of the projectile coincidental to the centerline of the barrel during firing and subsequent flight.

The projectile has rotational symmetry about the centerline 22. In other words, if the projectile is rotated about the centerline 22, the observed shape will not change both externally and internally, for the cavity. The left side, if there was a side designated as left, is always the same as the imaginary right side. The front or fore end is not symmetrical with the aft end of the projectile. Rotational symmetry is important for ballistic flight because the rotation imparted by the rifling spins the bullet, and the center of mass must not shift due to the rotation of the projectile in flight.

Both the projectile as a whole and the cavity 28 are both rotationally symmetrical about the centerline 22.

The entire length from fore to aft of the bearing surface 16 has a diameter equal to the caliber 42 of the projectile. This caliber 42 is complimentary to the dimensions of the interior of the barrel from inside which the projectile is fired.

Aft of the bearing surface 16 is the boattail 18 section. At the fore-most edge of the boattail 18 section the width of the projectile is nearly equal to that of the bearing surface 16 and therefore by extension the dimension of the caliber 42.

The aft end of the boattail 18 section terminates in the heel 26. The surface of the heel 26 is generally perpendicular to the flight path of the projectile. The greater diameter of the heel 26 is the base 20. Essentially, and when viewed from the aft end of the projectile, the heel 26 is ring shaped, bounded on the outer edge by the aft end of the boattail 18 and on the inner edge by the aperture 40.

The difference of the diameter of the base 20 and the diameter of the caliber 42 is shown as the draft 44. Since the projectile is generally symmetrical from left to right the draft 44, when viewed from the aft end of the projectile, is circular.

The projectile has an exterior surface 36 that surrounds the projectile. The surface 36 could be constructed of a jacket or could simply be the outside edge of the body 34 material. For example, the body 34 could be constructed of lead, steel, copper, depleted uranium or any other alloy, metal or material suitable to sustain the forces imposed on the projectile during firing, flight and impact as is decided suitable by a technician fabricating the projectile.

For most uses, a lead alloy or jacketed lead material is a good choice of material when considering availability of the material, cost, manufacturing process and application of the projectile is considered. However, any material known in the projectile field could be suitably adapted to work effectively with the design of the balance of the device as shown and described.

A cavity 28 is formed of a void inside the projectile. The cavity 28 is exposed from the aft end of the projectile at the aperture 40. The forward end of the cavity 28 terminates inside the projectile at the bottom 32. The bottom 32 surface is generally perpendicular to the flight path of the projectile and parallel to the heel 26 surface.

However, the bottom 32 need not be flat. It could equally be domed or have another shape. The shape of the bottom 32 could be conical if the cavity is formed by a drilling process or other process. Similarly, the bottom 32 could be domed if the cavity is formed by a swaging (stamping) process, molding/pouring process or for other reasons or manufacturing processes.

The edges of the bottom 32 is generally circular but could also take on another shape as desired or resulting from the manufacturing process of the projectile or for aesthetic reasons. The shape and configuration of the bottom 32 is not critical to the design of the projectile largely because it does not interact with the atmosphere as the projectile is in flight after firing. However, the location and positioning of the bottom 32 is important to the performance of the projectile.

An important distinguishing feature of this projectile is the cavity 28 and its dimensions in relation to the balance of the projectile. In a valued version of the projectile the dimension of the diameter of the bottom 32 is less than or equal to the diameter of the aperture 40 but not smaller than about a quarter of the diameter of the base 20. The diameter of the base 20 is about half, plus or minus about five percent of the dimension of the caliber 42. The length of the boattail 18 is equal to twenty five percent of the overall length of the entire projectile, plus or minus five percent. The depth 31, as measured from the heel 26 to the bottom 32 is from the shoulder 24 forward or aft about ten percent the overall length of the projectile. Generally, when the diameter of the aperture is the same as the diameter of the base then the cavity is cylindrical. When the diameter of the aperture is greater than the diameter of the base then the cavity tapers, being narrower at the fore end than the aft end. The aperture is on the base surface and therefore must be about the same size as the base or less. In some forms of the projectile the aperture diameter is not less than about half the diameter of the base.

In another version of the projectile the size of the aperture is: (the base diameter−the aperture diameter) divided by two, is less than or equal to fifteen percent of the caliber. The term caliber is also sometimes referred to as the bearing surface diameter.

The shoulder 24 is a point where the curve of the ogive section transitions to the cylindrical shape of the bearing surface section 16. The shoulder 24 can appear to be a ring around the projectile made by the change in profile. The shoulder 24 is the forward most part of the projectile that is in barrel contact while the projectile is being fired. For purposes of measuring and positioning the cavity inside the projectile the shoulder 24 can be considered to be a plane perpendicular to the flight path the projectile that intersects the shoulder on the exterior surface of the projectile.

Each of these ranges can be within about plus or minus fifteen percent of these stated ranges and remain effective and intended to be incorporated to said ranges and proportions.

Another proportional description of the projectile can be fairly described as: the base 20 is half the caliber 42 plus or minus ten percent; the diameter of the aperture 40 is two thirds of the diameter of the base 20 plus or minus ten percent; the length of the boattail is twice the diameter of the aperture 40 plus or minus ten percent; the diameter of the aperture 40 is less than or equal to the length of the bearing surface 16; the bearing surface 16 is less than or equal to two-thirds of the caliber 42; and the length of the depth 31 of the between the bottom 32 and the shoulder 24 is about eighty five percent to one hundred twenty five percent the sum of the lengths of the boattail 18 and bearing surface 16; the cavity is formed symmetrically inside the body 34 of the projectile between the bottom 32 and the aperture 40.

Figure 2:
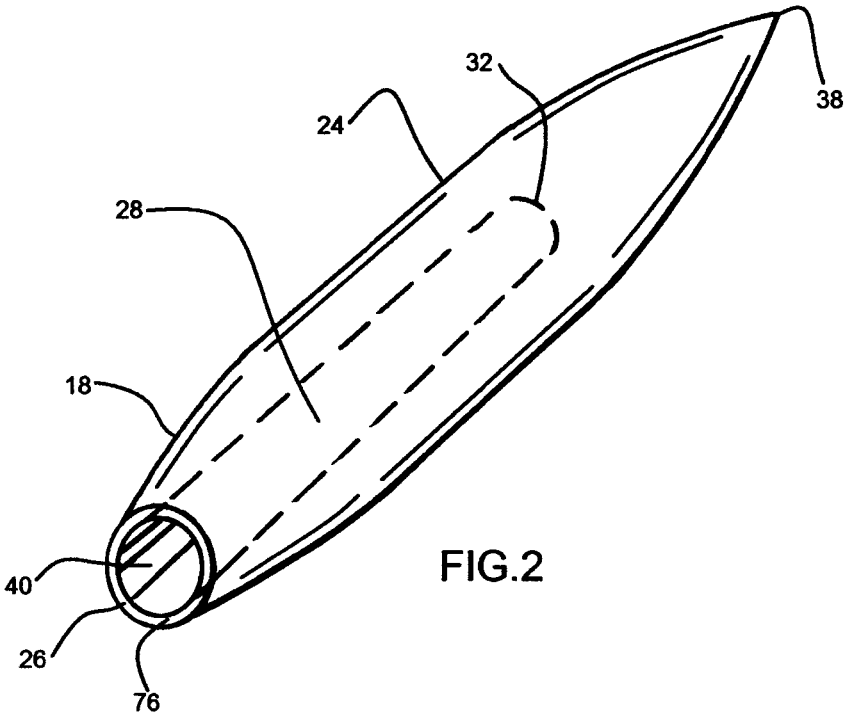
FIG. 2 shows a perspective view of another example of a projectile similar to that shown in FIG. 1.

FIG. 2 is an alternate view of a substantially analogous projectile to the projectile seen in FIG. 1 and described in detail above. The tip 38 is at the forward end of the projectile and the heel 26 is at the aft end. The aperture 40 in the aft end of the projectile exposes the cavity 28 to the propellant during the firing process.

It can be seen in this view that the cavity 28 is open at the aperture 40 on the aft end and extends to the bottom 32. The bottom 32 is roughly to the transition point between the ogive 14 and bearing surface 16. Note that the diameter of the cavity 28 can be the same from the aperture 40 on the aft end all the length to the bottom 32. Alternatively, the diameter of the cavity 28 can taper from slightly wider at the aperture 40 to narrower at the bottom 32.

Figure 3:
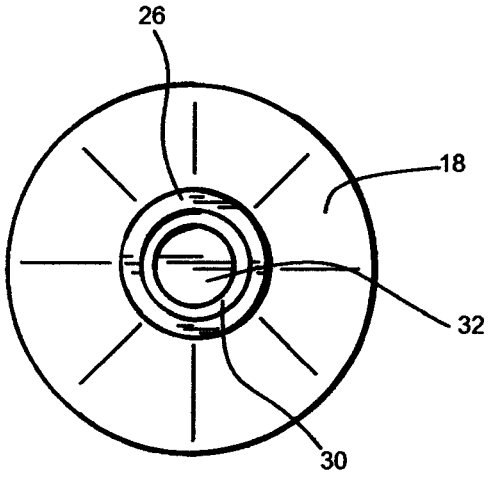
FIG. 3 illustrates an elevation view looking towards a trailing edge of a projectile.

FIG. 3 is yet another view of a materially similar projectile to that seen in FIGS. 1 and 2 and described above. The draft of the boattail 18 is seen in relation to the edge 30 and bottom 32. It can be observed from this view that the bottom 32 is narrower in diameter than the aperture 40 (identified on FIG. 2).

Figure 4:
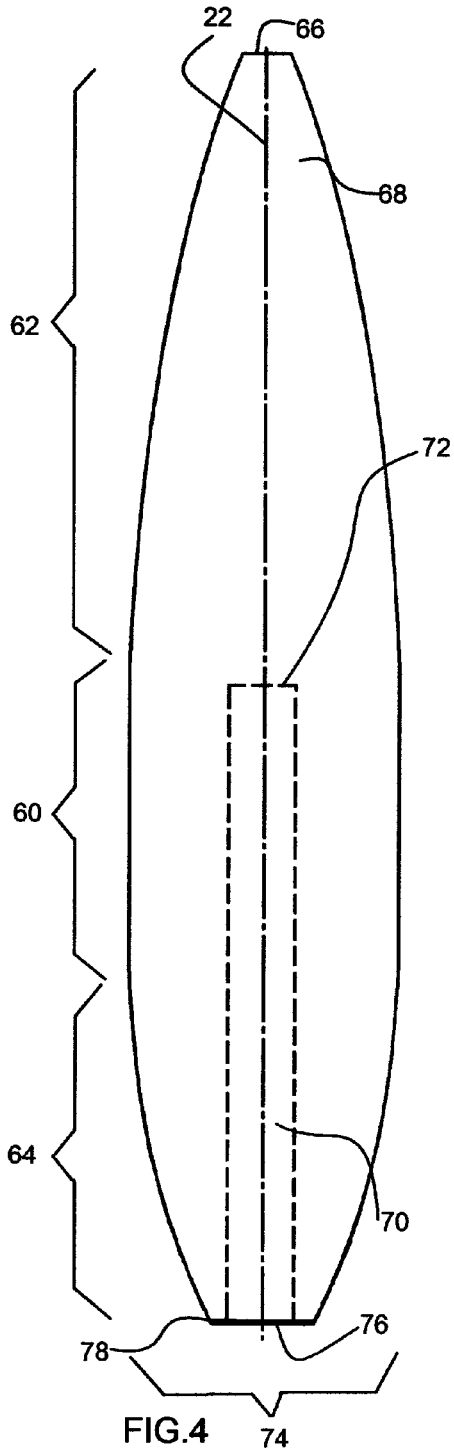
FIG. 4 is a representation of a plan view of a variation of a projectile including hidden lines that show an exemplar interior configuration.

Now referring to FIG. 4 where another version of the present invention is shown that follows the general spirit and parameters of the concept but has some differences and includes, among other features, a centerline 22, a bearing surface 60, a nose 62, a boattail 64, a tip 66, a body 68, a cavity 70, a bottom 72, a caliber 74, an aperture 76 and a heel 78.

FIG. 4 shows an alternate configuration that has similar features and proportions to the example shown in FIG. 1. A centerline 22 is shown that is the center of the projectile as well as being coincidental to the trajectory of the projectile's flight path.

Also demonstrated in FIG. 4 is an alternate tip 66. The projectile can effectively have a flat tip, hollow point, fragmented or frangible tip, wad cutter or any other type of tip known to be effective for a particular purpose. The more important aspect is the dimensions and ratios of the cavity inside the center of the projectile that is positioned from the aperture 76 on the aft end, surrounded by the heel 78 that traverses to a point where the bearing surface 60 intersects the nose 62 section.

This bullet when used as an air gun bullet, with a cavity in the center from the aft of the bullet to about the on the inside of the bullet, allows the air gun bullet to evenly collapse (to be swaged) inward as it passes through a choked air gun barrel. This happens without being significantly distorted and losing significant velocity.

Many air gun barrel manufactures use choked air gun barrels. In contrast, a solid conventional firearms bullet can easily become stuck in the choke of an air gun barrel. If the bullet alloy is soft enough to pass through, then it could become unevenly deformed after passing through a choked barrel in an air gun.

There are a small but significant number of firearm barrels that are choked. When a firearms bullet is fired through a choked firearms barrel, this does not manifest itself because the ratio of the choke to the barrels bore and groove dimensions are proportionately different. Further, the alloy of a firearms bullet is generally much harder and the gas propellant forces are orders of magnitude higher than those in an air gun.

Because there is no hole in the center of conventional firearm bullet, when used as an air gun projectile (for example, a pellet), it is not as effective as an airgun projectile in airgun barrels. Air gun barrels are designed for airgun pellets. Without the hole in the center, a conventional firearms bullet used in an airgun can cause uneven bullet deformity as it passes through the choke and that will create an unstable and inconsistent flight trajectory after leaving the barrel.

Without the hole in the center, more energy is required for a conventional firearms bullet to be passed through the choke of an air gun barrel as the bullet is swaged through. In this case it will significantly slow down the bullet as it goes through the choke. The air gun bullet will maintain its uniformly concentric shape for long range accuracy and with very little loss of velocity or energy as it is swaged through the choke in an air gun barrel. The air gun bullet will maintain a stable and consistent flight trajectory after leaving a choked air gun barrel.

In an important version of the present invention, when it is used as an air gun bullet it has a rear hole in the center to allow expanding or compressed gases to fill all the way to the beginning of the shoulder 24 in FIG. 1 on the inside of the bullet and thus expanding the bullets entire bearing surface. This allows the bullet to engage and perfectly conform into the rifling grooves as it is being propelled through the barrel while generating rifled spin.

The hollow space of the hole in the center of the air gun bullet does not conform to the outer edges of a hollow skirt as in air gun pellets. The hole in the air gun bullet does not border or engage a skirt. An airgun pellet's skirt as it is filled with gases during the firing process in the barrel only engages the rifling grooves with a thin outer edge of the skirt and sometimes the head.

This air gun bullet is primarily stabilized by spin generated in the barrel by its bearing surface engagement with the rifling by expanding gases in the hole, and this allows it to use an efficiently low drag spire (spritzer-type) point bullet nose with an elongated efficient pin tail (or boat tail) shape that keeps air drag to a minimum after leaving the barrel. This is more aerodynamic than most skirted air gun pellet projectiles. It retains its velocity and energy at far greater distances and is less affected by crosswinds that can change the point of impact.

The combination of these features also allows for increased depth of penetration into the target. In contrast, an air gun pellet has a skirt that is often wider than the head of the pellet for the purpose of engaging the rifling for spin stability and to decrease drag in the barrel as the only surface engaging the rifling.

Further, for external ballistic stability after leaving the barrel, this feature creates large amounts of drag in the air after a skirted air gun pellet leaves the barrel. This can detract from the preferred ballistic performance of the projectile.

The present design, when used as an air gun bullet or a firearms bullet, has a rear hole in the center all the way to the beginning of the shoulder 24 in FIG. 1 on the inside of the bullet. Thus, it has an internal cavity that displaces more bullet mass further from the rotational center axis to the outer circumference of the bullet.

This concept can increase the stability of the projectile in flight in a gyroscopic effect. By redistributing the mass of the projectile the rotational energy of the projectile while in the flight path can be better controlled to enhance flight characteristics.

A version of this bullet could be longer overall and with a longer barrel bearing length and therefore an increased ballistic coefficient than when compared to a solid bullet of the material with the same weight and the same nose and tail shape.

The hollow internal cavity of the bullet provides for a higher moment of inertia which enhances its opposition to changes in its rotational motion. These features allow for this bullet to achieve external ballistic stability with a barrel having a slower twist rate. Similarly, the velocity of the bullet could be effective at a slower rate (for subsonic use) than would be needed for a solid bullet of the same weight or length and to achieve greater external ballistic stability.

This characteristic is particularly true for when the bullet transitions from supersonic to subsonic velocity. That will increase both the accuracy and range of the bullet.

To a degree, drag is continuously reduced as tail length grows. The length of the bullets tail is practically limited by stability concerns. This increased external ballistic stability allows for the use of a much longer boat tail or a much longer and more efficient pin tail design to achieve very low drag when compared to a solid bullet of the same weight. This can increase both the accuracy and range of the bullet at supersonic and subsonic velocity.

On impact with soft tissue, the hollow cavity becomes easily deformed internally and altering its center of gravity. This instability causes a tumbling effect in the soft tissue of the target and thus increasing the area of tissue damage.

Modern air guns are increasing in power by using high pressure gas tanks made of composite materials such as carbon fiber or by using pneumatic gas pistons instead of metal springs for propelling pellets. Some air guns are capable of launching lite pellets at supersonic speeds.

These same principals of physics are applicable for this bullet design in both air guns and firearms. This transonic bullet may be propelled by compressed expanding gases, explosive propellant or magnetic forces.

Each of these types of projectile propulsion systems would benefit from the design of the bullet as described herein.

A projectile can be fairly described as having an ogive section forward of a bearing surface section that is in turn forward of a boattail section. The aft end of the projectile is at an aft end of the boattail section which terminated at a base. The projectile is rotationally symmetrical with a rotationally symmetrical cavity (hollow area) is positioned inside the projectile and has a depth bounded at a fore end at a bottom (in the interior of the projectile) and at an aft end opens at the base. The cavity is open on the aft end of the boattail section at an aperture forming an opening in the center of the base. The bearing surface section has a first diameter, alternatively referred to as the caliber. The bottom as a second diameter where the cavity terminates inside the projectile. The aperture has a third diameter across a portion of the base. The base has a fourth diameter at the aft end of the projectile. The boattail section, bearing surface section and depth each have a distinct predetermined length. The diameter is constant from a fore end to an aft end of the bearing surface section, making it generally cylindrical in shape. The diameter of the bottom is less than or equal to the diameter of the aperture and greater than or equal to about a quarter of the diameter of the base. The aperture diameter is less than or equal to the diameter of the base. The diameter of the base is less than or equal to about fifty-five percent of the diameter of the bearing surface section. The depth of the cavity is between eighty-five percent and one hundred twenty-five percent of the sum of the combined lengths of the boattail section and bearing surface section.

A projectile can optionally have a length of the boattail section greater than or equal to the diameter of the aperture and less than or equal to two hundred percent of the aperture.

A projectile can optionally have the length of the boattail section greater than or equal to the diameter of the bearing surface and less than or equal to one hundred fifty percent of the bearing surface diameter.

A projectile can be fairly described as having an ogive forward of a bearing surface forward of a boattail with a cavity is formed on an interior of the projectile. The cavity has a closed fore end terminating inside the projectile and an open aft end at an aperture on an aft end of the boattail. The projectile and cavity are both rotationally symmetrical about a centerline of the projectile. The boattail has a first length from a fore end of the boattail to an aft end of the boattail. At the aft end of the boattail is a base. The bearing surface has a second length from a fore end of the bearing surface to an aft end of the bearing surface. The cavity has a third length from the closed fore end to the open aft end. The bearing surface has a constant first diameter along the entire second length. The fore end of the cavity as a predetermined diameter. The aperture has a predetermined diameter. The base has a predetermined diameter. The length of the boattail is between one hundred fifty percent and two hundred fifty percent of the diameter of the aperture. The length of the cavity is between eighty-five percent and one hundred twenty-five percent of the sum of the length of the boattail section and the length of the bearing surface section. The diameter of the aperture is between sixty-five percent and one hundred percent of the diameter of the base. The diameter of the base is between forty and sixty percent of the diameter of the bearing surface. The diameter of the front end of the cavity is less than or equal to the diameter of the aperture.

A projectile can be fairly described as having an ogive section forward of a bearing surface section forward of a boattail section. A shoulder is identified where the ogive section transitions into the bearing surface section. An aft end of the boattail section terminates on an aft end of the projectile at a base. The bearing surface has a bearing surface diameter that is consistent from a forward side of the bearing surface to an aft side of the bearing surface making is essentially cylindrical. The base has a base diameter that is between forty-five and fifty-five percent of the bearing surface diameter. The projectile has an overall length that is a sum of an ogive section length and a bearing surface section length and a boattail section length. The boattail section length is between twenty to thirty percent of the overall length of the projectile. A cavity is formed rotationally symmetrical inside the projectile and is bounded by the base at an aperture and at a forward end at a bottom. The bottom is positioned within ten percent of the overall length measured forward or aft from the shoulder. The bottom has a bottom diameter that is between twenty-five and one-hundred percent of the base diameter. The bottom diameter is less than or equal to an aperture diameter. Half of the difference between the base diameter and the aperture diameter is less than or equal to fifteen percent of the bearing surface diameter.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A projectile having an ogive section (14) forward of a bearing surface section (16) forward of a boattail section (18);

an aft end of the projectile is at an aft end of the boattail section (18) at a base (20);

the projectile is rotationally symmetrical;

a rotationally symmetrical cavity (28) is positioned inside the projectile and has a depth (31) bounded at a fore end at a bottom (32) and at an aft end at the base (20);

the cavity (28) is open on the aft end of the boattail section (18) at an aperture (40) formed in the base (20);

the bearing surface section (16) has a first diameter;

the bottom (32) as a second diameter;

the aperture (40) has a third diameter;

the base (20) has a fourth diameter;

the boattail section (18) has a first length;

the bearing surface section (16) has a second length;

the depth (31) has a third length;

the first diameter is constant from a fore end to an aft end of the bearing surface section (16);

the second diameter that is less than or equal to the third diameter and greater than or equal to about a quarter of the fourth diameter;

the third diameter is less than or equal to the fourth diameter;

the fourth diameter is less than or equal to fifty-five percent of the first diameter;

the third length is between eighty-five percent and one hundred twenty-five percent of the sum of the first length and the second length.

2. A projectile as in claim 1 further characterized in that the first length is greater than or equal to the third diameter and is less than or equal to two hundred percent of the third diameter.

3. A projectile as in claim 1 further characterized in that the first length is greater than or equal to the first diameter and is less than or equal to one hundred fifty percent of the first diameter.

4. A projectile having an ogive forward of a bearing surface forward of a boattail;

a cavity is formed on an interior of the projectile;

the cavity has a closed fore end terminating inside the projectile and an open aft end at an aperture on an aft end of the boattail;

the projectile and cavity are both rotationally symmetrical about a centerline of the projectile;

the boattail has a first length from a fore end of the boattail to an aft end of the boattail;

at the aft end of the boattail is a base;

the bearing surface has a second length from a fore end of the bearing surface to an aft end of the bearing surface;

the cavity has a third length from the closed fore end to the open aft end;

the bearing surface has a constant first diameter along the entire second length;

the fore end of the cavity as a second diameter;

the aperture has a third diameter;

the base has a fourth diameter;

the first length is between one hundred fifty percent and two hundred fifty percent of the third diameter;

the third length is between eighty-five percent and one hundred twenty-five percent of the sum of the first length and second length;

the third diameter is between sixty-five percent and one hundred percent of the fourth diameter;

the fourth diameter is between forty and sixty percent of the first diameter;

the second diameter is less than or equal to the third diameter.

5. A projectile having an ogive section forward of a smooth, symmetrically cylindrical bearing surface section forward of a boattail section;

a shoulder is where the ogive section transitions into the bearing surface section;

an aft end of the boattail section terminates on an aft end of the projectile at a base;

the bearing surface has a bearing surface diameter that is consistent from a forward side of the bearing surface to an aft side of the bearing surface;

the base has a base diameter that is between forty-five and fifty-five percent of the bearing surface diameter;

the projectile has an overall length that is a sum of an ogive section length and a bearing surface section length and a boattail section length;

the boattail section length is between twenty to thirty percent of the overall length;

the shoulder is then determined to be at any given point forward from the difference of the overall length and a boattail length;

the bearing surface length is then derived to be from the shoulder to the forward end of the boattail where it transitions into a boattail section;

the nose length is then determined to be from the shoulder to a tip derived from the overall length less the sum of the bearing surface length and boattail length;

a cavity is formed rotationally symmetrical inside the projectile and is bounded by the base at an aperture and at a forward end at a bottom;

the bottom is positioned within ten percent of the overall length measured forward or aft from the shoulder;

the bottom has a bottom diameter that is between twenty-five and one-hundred percent of the base diameter;

the bottom diameter is less than or equal to an aperture diameter;

the aperture diameter is equal to the base diameter less 20 percent of the bearing surface.

6. A projectile which is transonically stable for any given predetermined bearing surface diameter or caliber (42) with any given predetermined overall projectile length, comprising:

a projectile of any given predetermined overall projectile length is a sum of an ogive nose section length (14) (62) from a tip (38) or (66) and a bearing surface section length (16) (60) and a boattail section length (18) (64);

a projectile of any given predetermined bearing surface diameter or caliber (42);

a projectile having an ogive nose section (14) (62) forward of a bearing surface section (16) (60) forward of a boattail section (18) (64);

a shoulder (24) where the ogive nose section (14) (62) transitions into the bearing surface section (16) (60);

an aft end of the boattail section (18) (64) which terminates on an aft end of the projectile at a base (20) or heel (26);

a bearing surface (16) (60) that has a bearing surface diameter that is consistent from a forward side of the bearing surface to an aft side of the bearing surface;

base (20) with a base diameter (20) that is between forty-five and fifty-five percent of the bearing surface diameter or caliber (42);

a boattail section length (18) (64) that is between twenty to thirty percent of the overall projectile length from the tip (38) or (66) to the base (20) or heel (26);

a shoulder (24) that is determined to be at any given point forward from a difference of the overall projectile length and the boattail section length (18) (64);

a bearing surface length (16) (60) that is determined to be from the shoulder (24) to a forward end of the boattail where it transitions into the boattail section (18) (64);

a nose length (14) (62) that is determined to be from the shoulder (24) to the tip (38) or (66) derived from the overall projectile length less a sum of the bearing surface length (16) (60) and boattail length (18) (64);

a cavity (28) that is formed rotationally symmetrical inside the projectile and is bounded by the base (20) or heel (26) at an aperture (40) and at a forward end at a bottom (32);

a cavity (28) with an aperture (40) that is open to the inside of a case cartridge when used in a firearm, that proportionally compensates for displaced powder volume by the projectile in the case cartridge at any position;

a bottom (32) that is positioned within ten percent of the overall projectile length measured forward or aft from the shoulder (24);

a bottom (32) that has a bottom diameter (32) with a range that is from equal to the base diameter to greater than or equal to twenty-five percent of the base diameter (20);

a bottom diameter (32) that is less than or equal to an aperture diameter (40);

an aperture (40) has a diameter range that is less than the base diameter (20) and is greater than or equal to the base diameter (20) less 25 percent of the bearing surface diameter or caliber (42);

wherein the only other additionally applicable ranges to any said ranges or proportions are plus or minus 0.010 of an inch and then rounded up or down to a hundredth of an inch.

* * * * *